US008500481B2

(12) United States Patent
Lin et al.

(10) Patent No.: US 8,500,481 B2
(45) Date of Patent: Aug. 6, 2013

(54) CONNECTOR MECHANISM FOR CONNECTING A PLUG

(75) Inventors: Li-Sheng Lin, New Taipei (TW); Li-Wei Liu, New Taipei (TW)

(73) Assignee: Wistron Corporation, Xizhi Dist., New Taipei (TW)

( * ) Notice: Subject to any disclaimer, the term of this patent is extended or adjusted under 35 U.S.C. 154(b) by 0 days.

(21) Appl. No.: 13/452,951

(22) Filed: Apr. 23, 2012

(65) Prior Publication Data

US 2013/0034985 A1 Feb. 7, 2013

(30) Foreign Application Priority Data

Aug. 4, 2011 (TW) ..... 100127771 A

(51) Int. Cl.
*H01R 13/62* (2006.01)

(52) U.S. Cl.
USPC ..... 439/372; 439/138

(58) Field of Classification Search
USPC ..... 439/135–147, 345, 372, 373
See application file for complete search history.

(56) References Cited

U.S. PATENT DOCUMENTS

| | | | | |
|---|---|---|---|---|
| 5,879,173 | A * | 3/1999 | Poplawski et al. | 439/138 |
| 6,814,606 | B2 * | 11/2004 | Kobayashi | 439/372 |
| 7,052,306 | B2 * | 5/2006 | Ishigami et al. | 439/372 |
| 7,134,901 | B2 * | 11/2006 | Okura | 439/372 |
| 8,366,474 | B2 * | 2/2013 | Zhang et al. | 439/372 |

* cited by examiner

*Primary Examiner* — Khiem Nguyen
(74) *Attorney, Agent, or Firm* — Winston Hsu; Scott Margo

(57) ABSTRACT

A connector mechanism includes a housing whereon an opening is formed, a socket, and a rotary casing for rotatably covering the opening. The rotary covering includes a main body, a pivoting portion, a stopping portion, and an engaging portion for engaging with an engaging structure of a plug as the plug is inserted into the opening and fastened on the socket so as to fix the plug. The connector mechanism further includes a resilient component for driving the rotary covering to rotate relative to the housing so that the engaging portion engages with the engaging structure of the plug as the plug is fastened on the socket, and a stopping component for stopping the stopping portion of the rotary covering as the resilient component drives the rotary covering to rotate relative to the housing.

7 Claims, 11 Drawing Sheets

CONNECTOR MECHANISM FOR CONNECTING A PLUG

BACKGROUND OF THE INVENTION

1. Field of the Invention

The present invention relates to a connector mechanism for connecting a plug, and more specifically, to a connector mechanism capable of fastening a plug without a latching tang.

2. Description of the Prior Art

With the development of information and computer technology, the size of a computer is becoming smaller and the computer is utilized in a wide variety of fields. In order to expand functions of the computer system for satisfying a user's various demands, various external devices of the computer system come out. For example, an external hard disk drive and a portable storage device can expand the memory capacity of the computer system. An external optical disk drive and an optical disk writer can expand multimedia resource access function of the computer system. A network allows the computer system to be connected to an internet so as to gather information online or surf webpage. For example, an Ethernet port, such as a RJ 45 port, is disposed on a lateral side of the notebook computer and for connecting to network. A network cable connects to the network port via a plug with a deformable latching tang to be secured into a jack of the network port. However, the deformable latching tang tends to be physically fragile, and if broken by frequent insertion, although it still permits the engagement of the plug into the jack, it will not provide a positive lock of the plug with respective to the jack. It might cause disconnection of network communication due to poor contact of the plug and the jack, resulting in replacement of the plug and reduction of product reliability.

SUMMARY OF THE INVENTION

The present invention provides a connector mechanism capable of fastening a plug without a latching tang, to solve the problems mentioned above.

According to the claimed invention, a connector mechanism includes a housing whereon an opening is formed. The connector mechanism further includes a socket installed inside the housing and disposed on a side of the opening. The connector mechanism further includes a rotary covering for rotatably covering the opening. The rotary covering includes a main body, a pivoting portion connected to the main body and pivoted to an inner side of the housing, a stopping portion connected to the main body, and an engaging portion connected to the main body, for engaging with an engaging structure of a plug as the plug is inserted into the opening and fastened on the socket so as to fix the plug. The connector mechanism further includes a resilient component connected to the inner side of the housing and the rotary covering, for driving the rotary covering to rotate relative to the housing so that the engaging portion engages with the engaging structure of the plug as the plug is fastened on the socket. The connector mechanism further includes a stopping component disposed on the housing nearby the opening, for stopping the stopping portion of the rotary covering as the resilient component drives the rotary covering to rotate relative to the housing.

According to the claimed invention, a size of the main body is substantially smaller than or equal to a size of the opening.

According to the claimed invention, the resilient component is further for driving the rotary covering to cover the opening partially or completely as the plug is not inserted into the opening.

According to the claimed invention, the pivoting portion is a shaft installed inside a slot of the housing in a rotatable manner.

According to the claimed invention, an arc surface or an inclined surface is formed on the engaging portion for guiding the rotary covering to rotate relative to housing as being pushed by the plug.

According to the claimed invention, the engaging portion and the engaging structure of the plug are respectively a rib structure and a slot structure.

According to the claimed invention, the main body, the pivoting portion, the stopping portion and the engaging portion are monolithically integrated.

The connection mechanism of the present invention utilizes the engagement of the engaging portion of the rotating covering and the engaging structure of the plug 62 to fasten the plug, instead of the conventional plug with the deformable latching tang to be secured into the jack of the network port. It can solve the problems that the deformable latching tang tends might be physically fragile, and if broken by frequent insertion, it will not provide a fastening function of the plug with respective to the jack. Hence, there is no need to arrange the latching tang for the plug cooperating with the connection mechanism of the present invention, and the connection mechanism of the present invention can cooperate with the conventional plug even with a broken latching tang, so as to enhance utilization convenience and product reliability.

These and other objectives of the present invention will no doubt become obvious to those of ordinary skill in the art after reading the following detailed description of the embodiment that is illustrated in the various figures and drawings.

DETAILED DESCRIPTION

Figure 1:
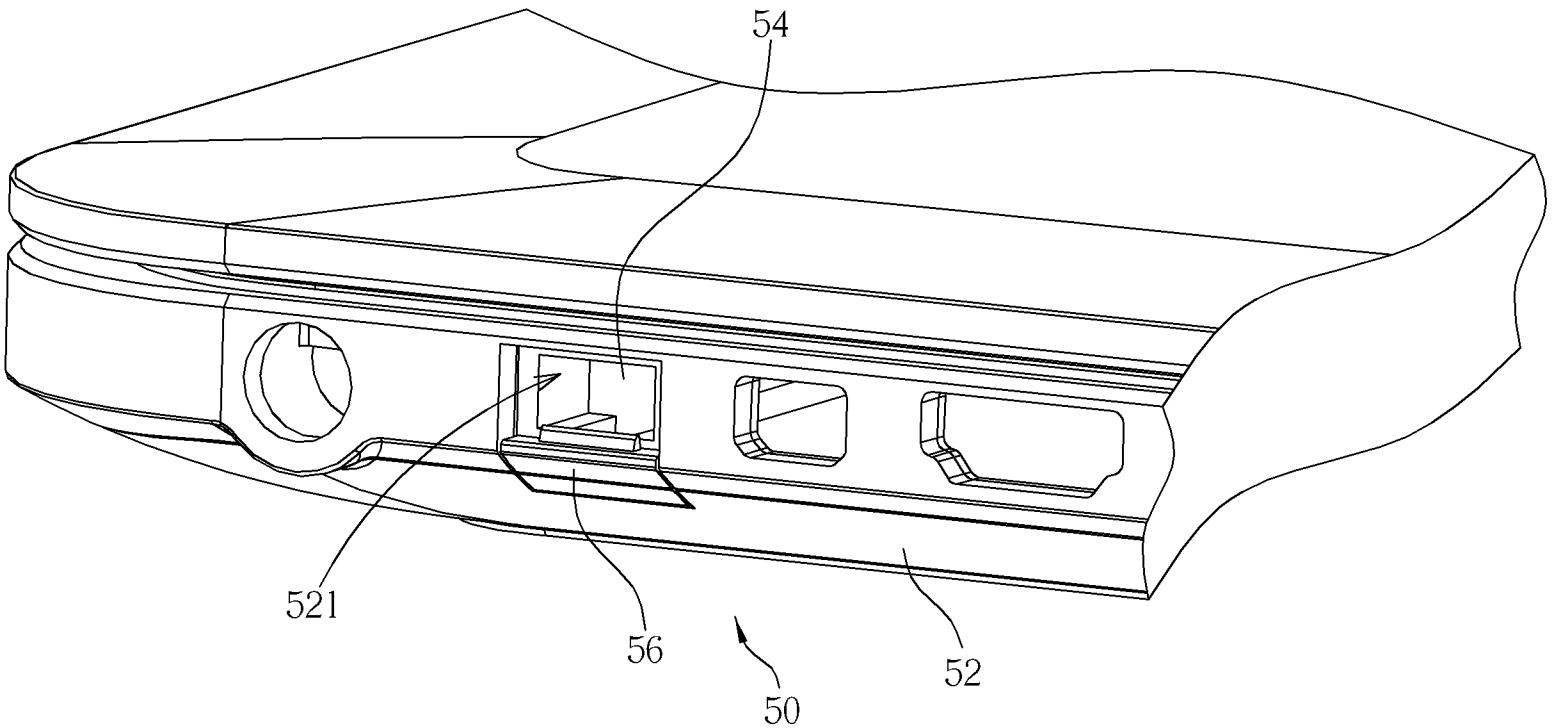
FIG. 1 is a schematic drawing of a connector mechanism according to an embodiment of the present invention.
Figure 2:
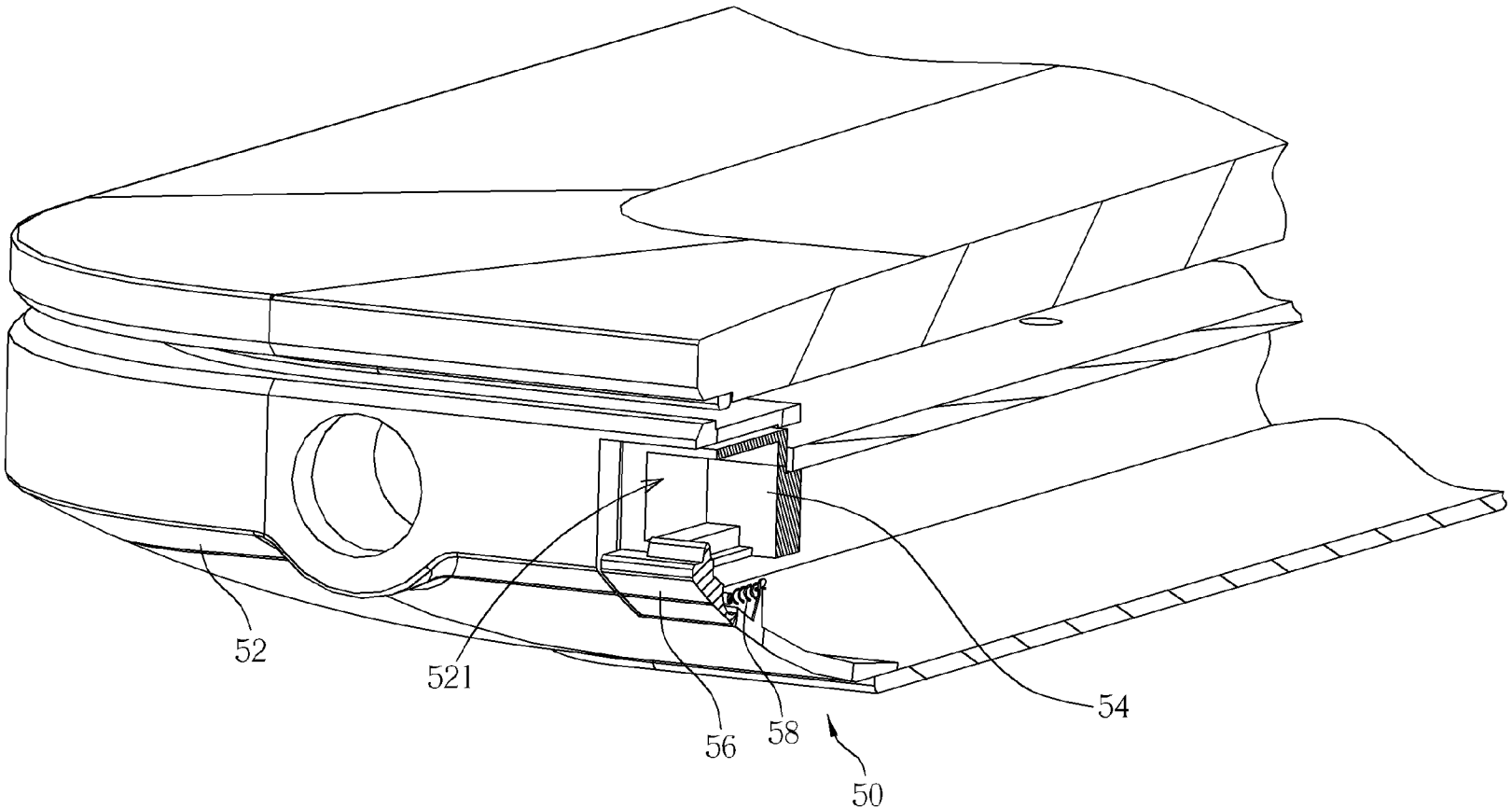
FIG. 2 is a sectional diagram showing the connector mechanism according to the embodiment of the present invention.
Figure 3:
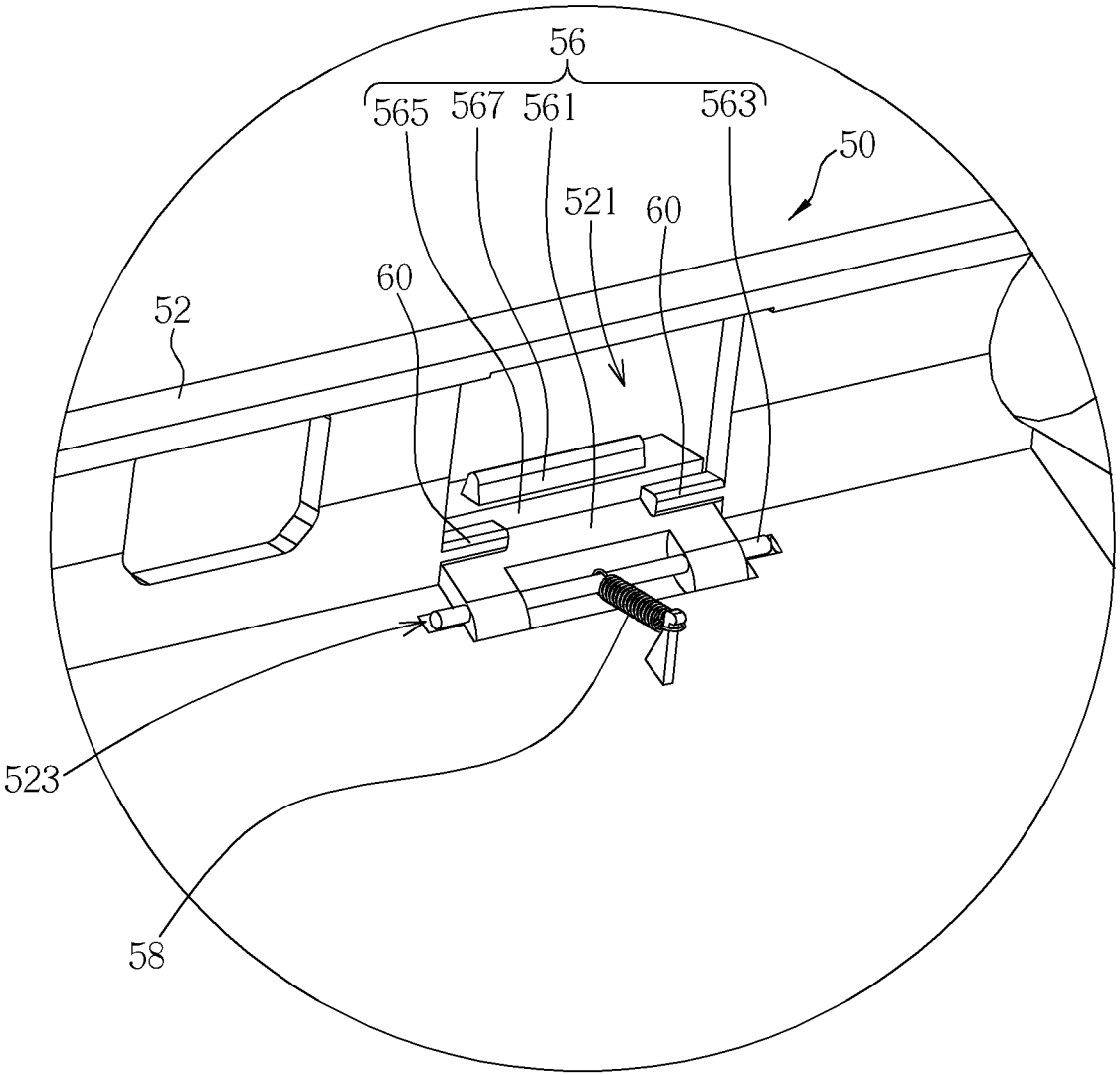
FIG. 3 is a partial structural diagram of the connector mechanism according to the embodiment of the present invention.

Please refer to FIG. 1 to FIG. 3. FIG. 1 is a schematic drawing of a connector mechanism 50 according to an embodiment of the present invention. FIG. 2 is a sectional diagram showing the connector mechanism 50 according to the embodiment of the present invention. FIG. 3 is a partial structural diagram of the connector mechanism 50 according to the embodiment of the present invention. The connector mechanism 50 can be disposed on a lateral side of a notebook computer. The connector mechanism 50 includes a housing 52 whereon an opening 521 is formed. The housing 52 can be a casing of the notebook computer. The connector mechanism 50 further includes a socket 54 installed inside the housing 52 and disposed on a side of the opening 521. The socket 54 can be an Ethernet jack, such as a RJ45 jack, for receiving a plug of a network cable.

Figure 4:
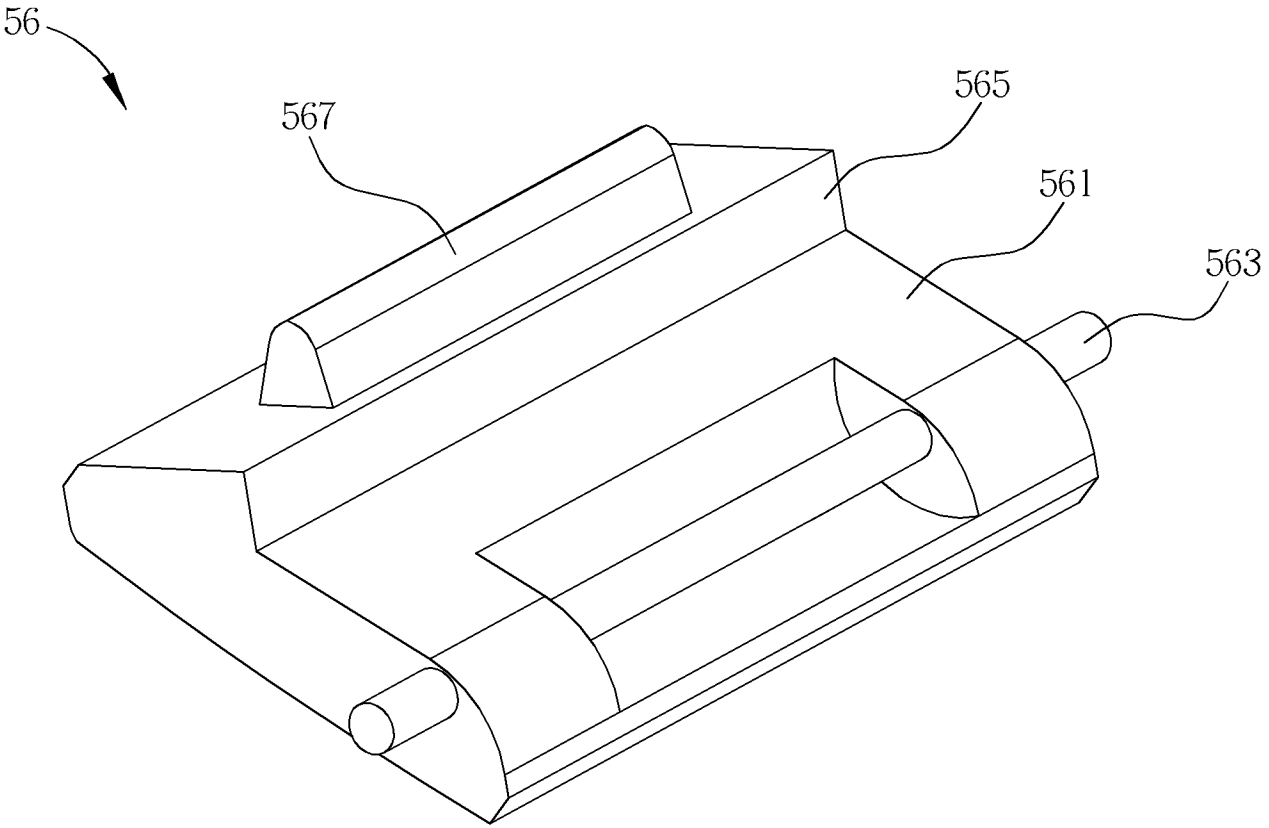
FIG. 4 is a diagram of a rotary covering according to the embodiment of the present invention.

The connector mechanism 50 further includes a rotary covering 56 for rotatably covering the opening 521. Please refer to FIG. 4. FIG. 4 is a diagram of the rotary covering 56 according to the embodiment of the present invention. The rotary covering 56 includes a main body 561, a pivoting portion 563, a stopping portion 565 and an engaging portion 567. The pivoting portion 563 is connected to the main body 561 and pivoted to an inner side of the housing 52. For example, the pivoting portion 563 can be a shaft installed inside a slot 523 of the housing 52 in a rotatable manner. The stopping portion 565 is connected to the main body 561 and can be a block structure. The engaging portion 567 is connected to the main body 561 and can be a rib structure formed on a side of the stopping portion 565. The main body 561, the pivoting portion 563, the stopping portion 565 and the engaging portion 567 can be monolithically integrated. The connector mechanism 50 further includes a resilient component 58 and at least one stopping component 60. The resilient component 58 is connected to the inner side of the housing 52 and the rotary covering 56, for driving the rotary covering 56 to rotate relative to the housing 52. The resilient component 58 can be a spring. The stopping component 60 is disposed on the housing 52 nearby the opening 521, for stopping the stopping portion 565 of the rotary covering 56 as the resilient component 58 drives the rotary covering 56 to rotate relative to the housing 52 so as to prevent the rotating covering 56 from rotating into the opening 521. In this embodiment, the connector mechanism 50 includes the two stopping components 60 respectively disposed on two sides of the opening 521. The disposal and amount of the stopping component 60 are not limited to those of the embodiment, and it depends on actual design demand.

Figure 5:
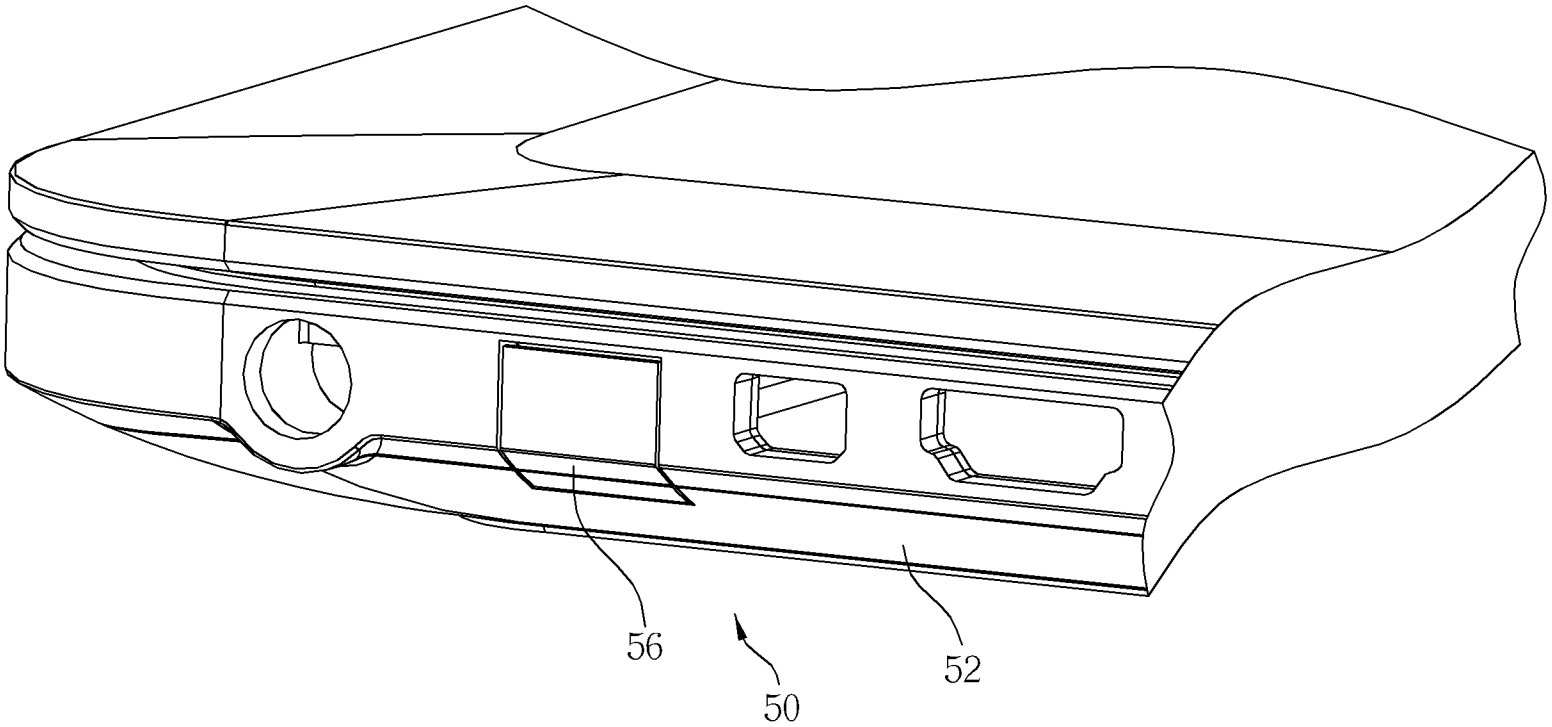
FIG. 5 is a schematic drawing of the connector mechanism according to another embodiment of the present invention.

Furthermore, a size of the main body 561 can be substantially smaller than or equal to a size of the opening 521, for shielding the opening 521 partially or completely. In this embodiment, the size of the main body 561 is substantially smaller than the size of the opening 521. As shown in FIG. 1, when an external plug is not inserted into the opening 521, the resilient component 58 can drive the main body 561 of the rotary covering 56 to cover the opening 521 partially. Please refer to FIG. 5. FIG. 5 is a schematic drawing of the connector mechanism 50 according to another embodiment of the present invention. In this embodiment, the size of the main body 561 is substantially equal to the size of the opening 521. When an external plug is not inserted into the opening 521, the resilient component 58 can drive the main body 561 of the rotary covering 56 to cover the opening 521 completely. The sizes and shapes of the main body 561 and the opening 521 can depend on actual design demand.

Figure 6:
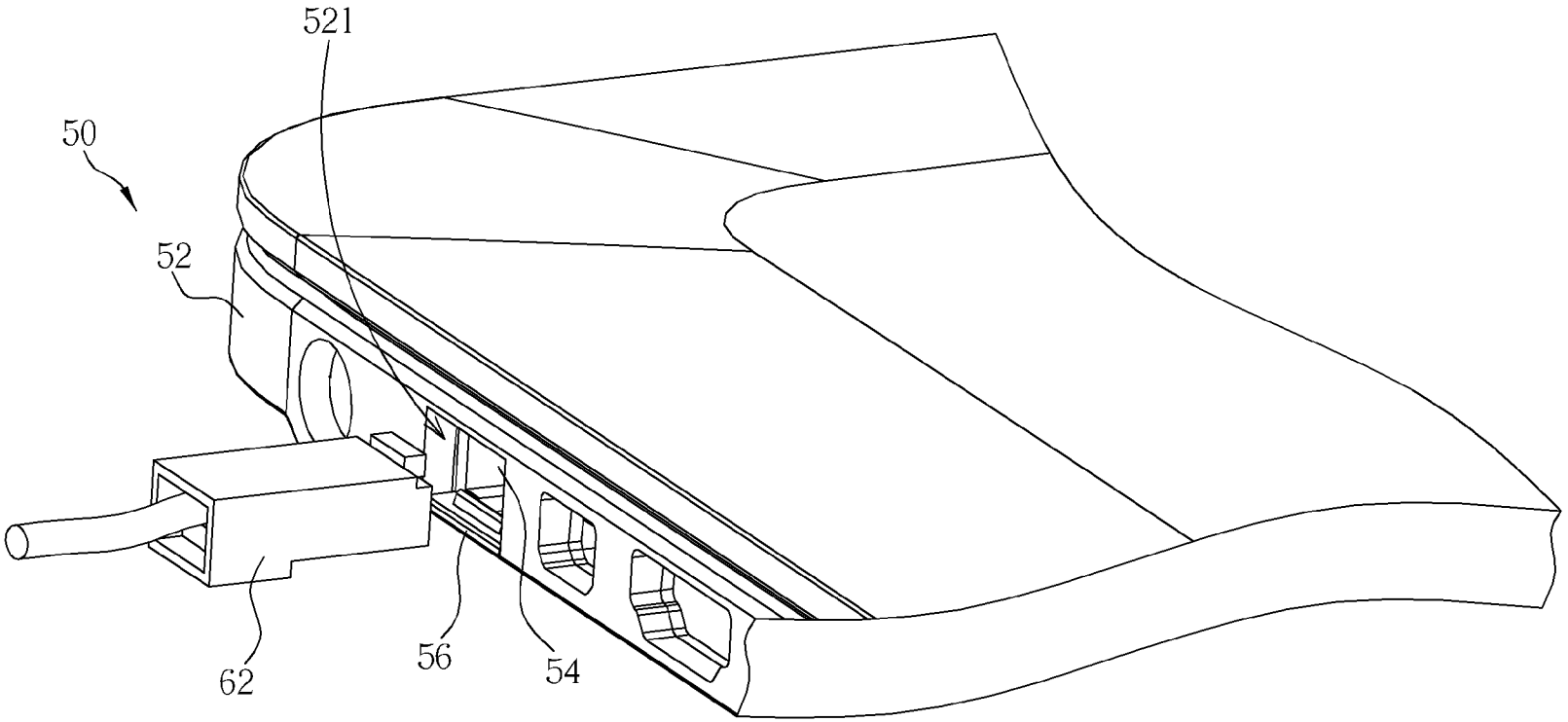
FIG. 6 to FIG. 8 are assembly diagrams of the connector mechanism connecting with a plug according to the embodiment of the present invention.
Figure 7:
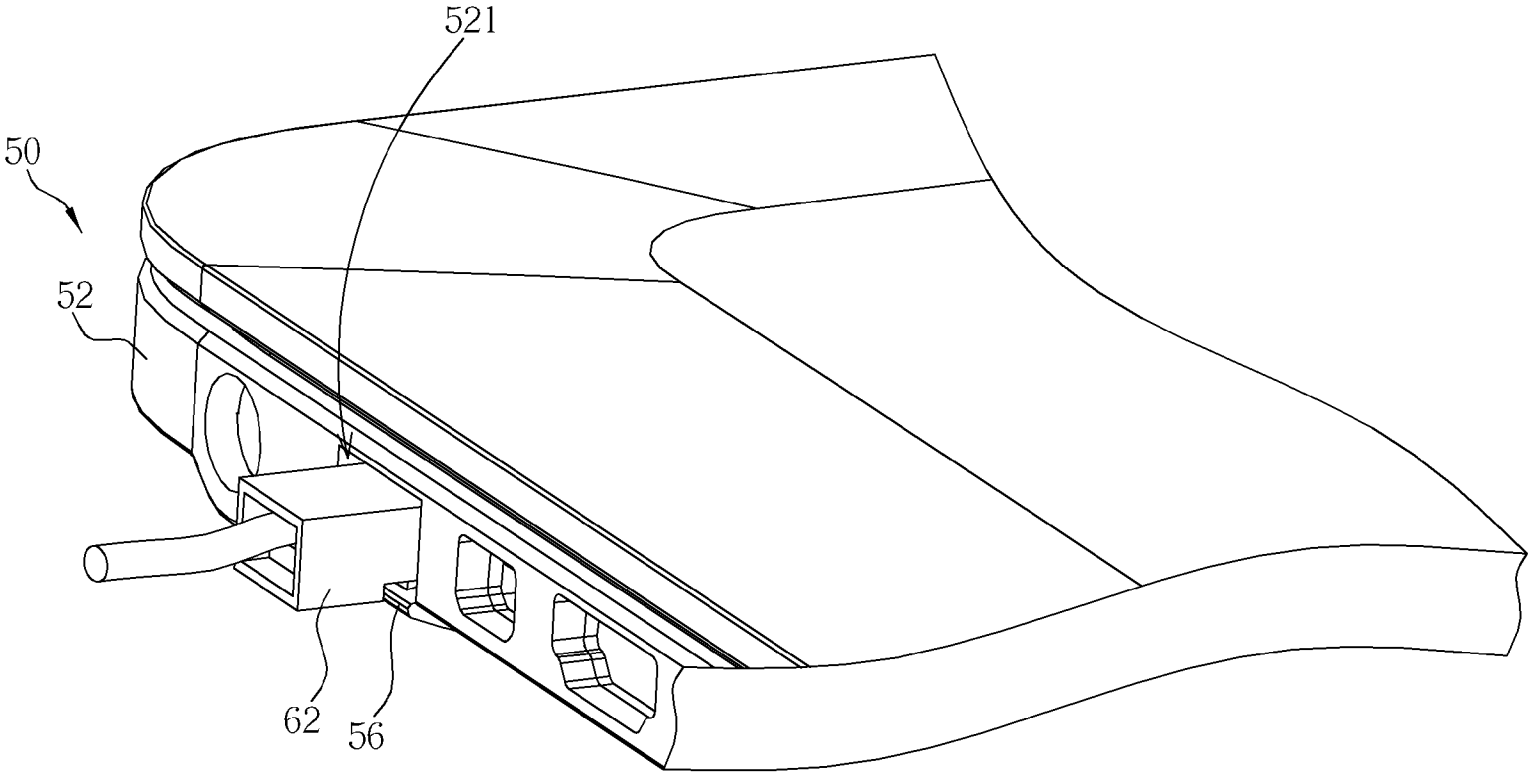
Figure 8:
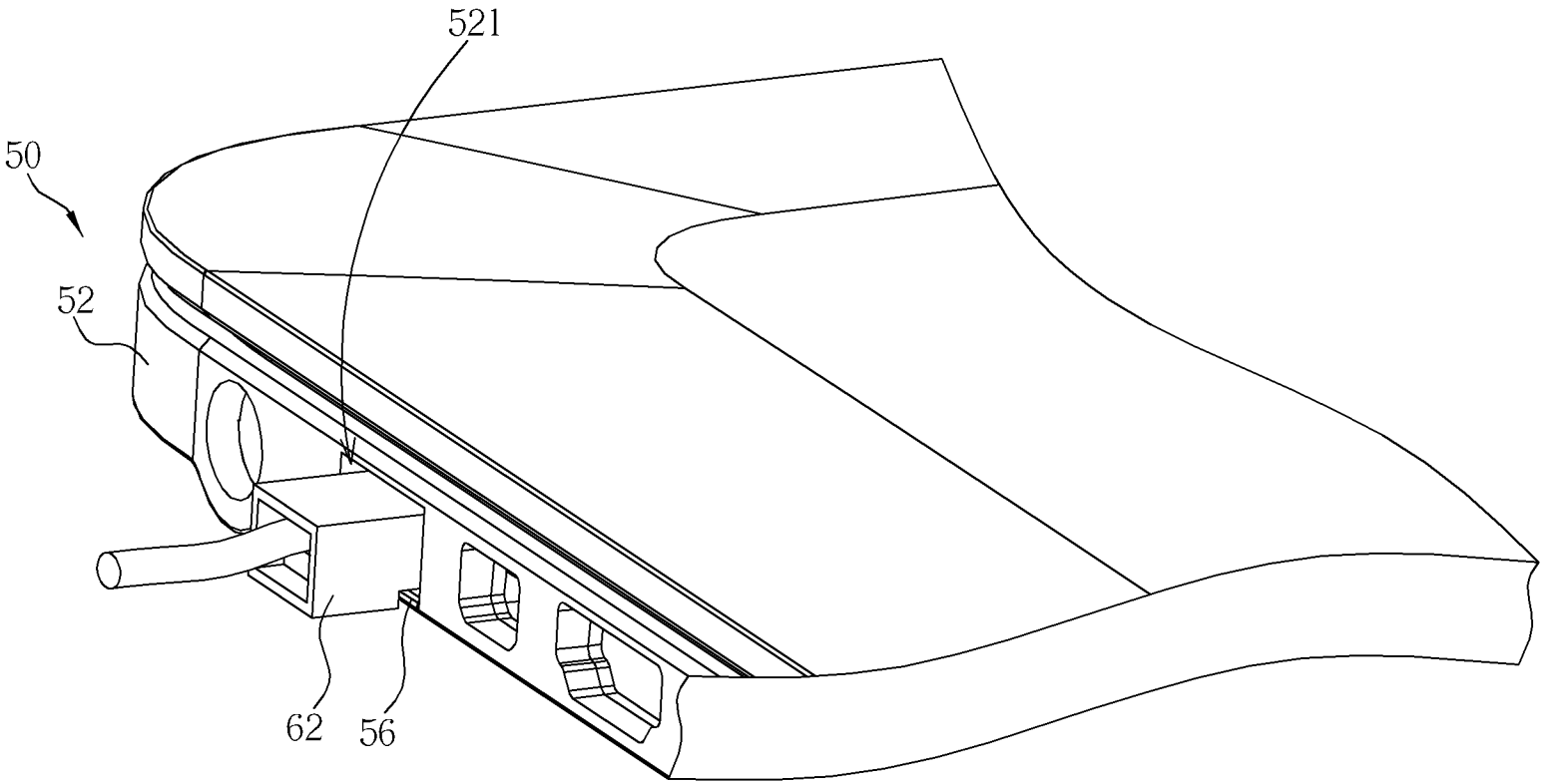
Figure 9:
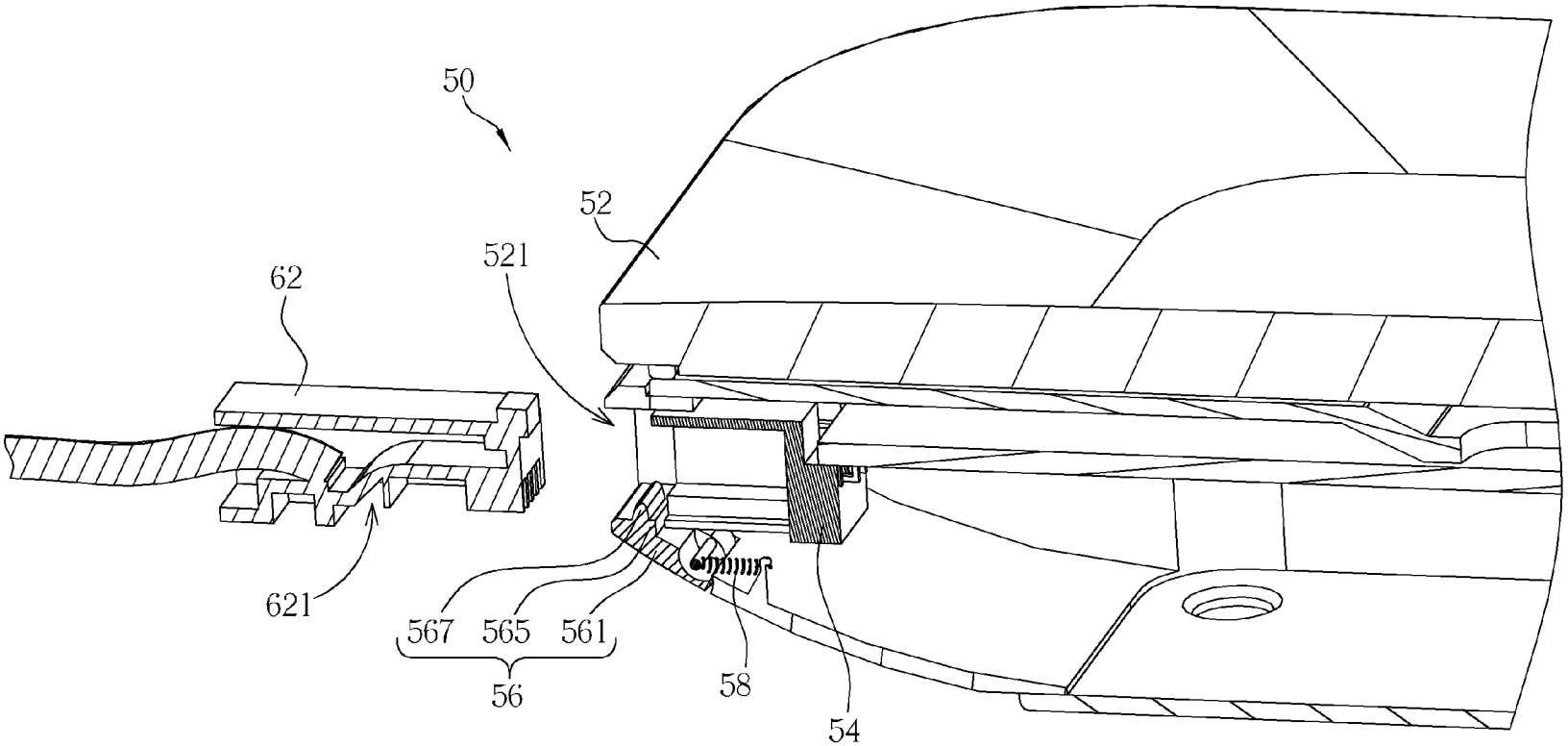
FIG. 9 to FIG. 11 are sectional diagrams showing the connector mechanism connecting with the plug corresponding to FIG. 6 to FIG. 8 according to the embodiment of the present invention.
Figure 10:
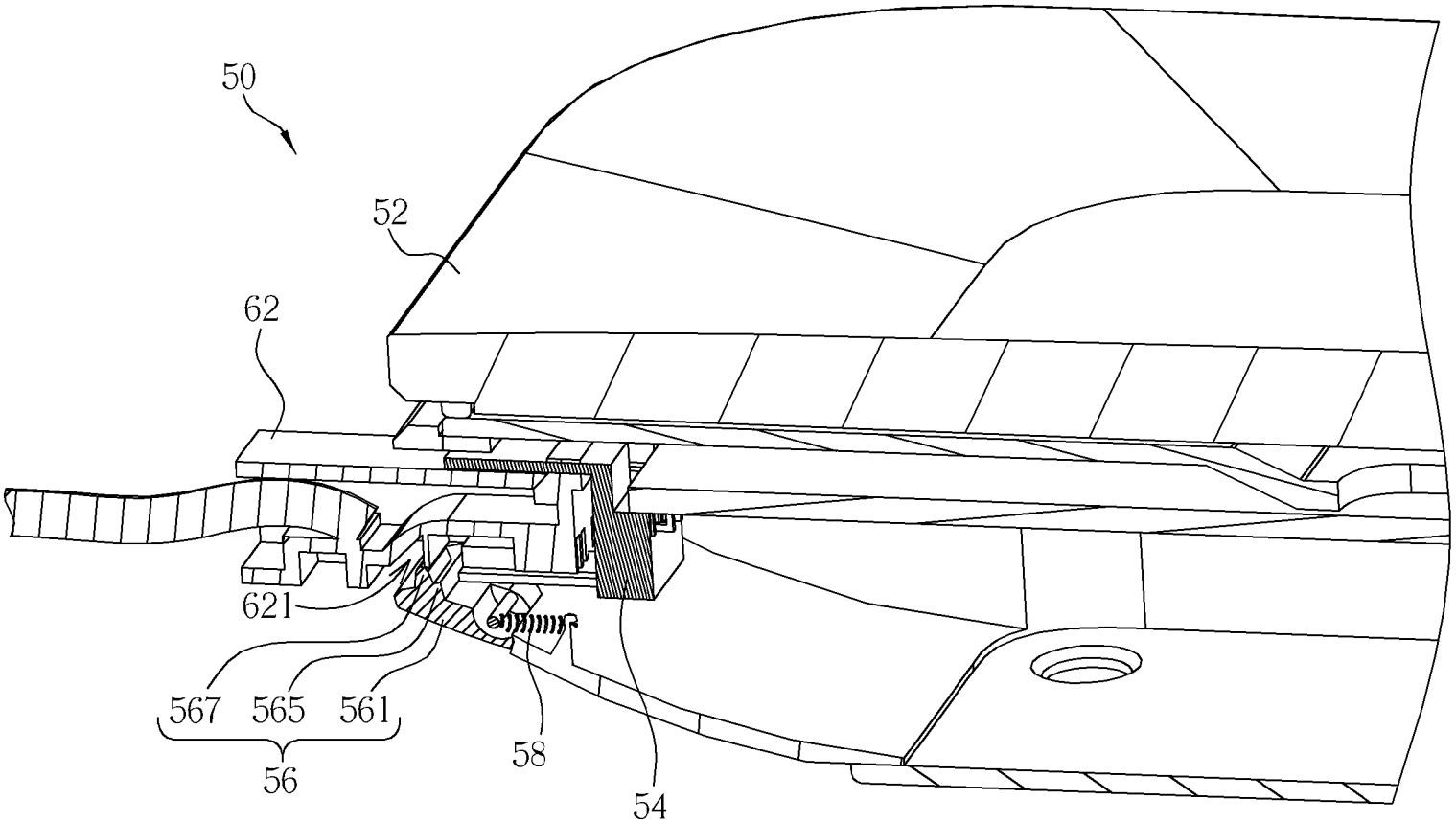
Figure 11:
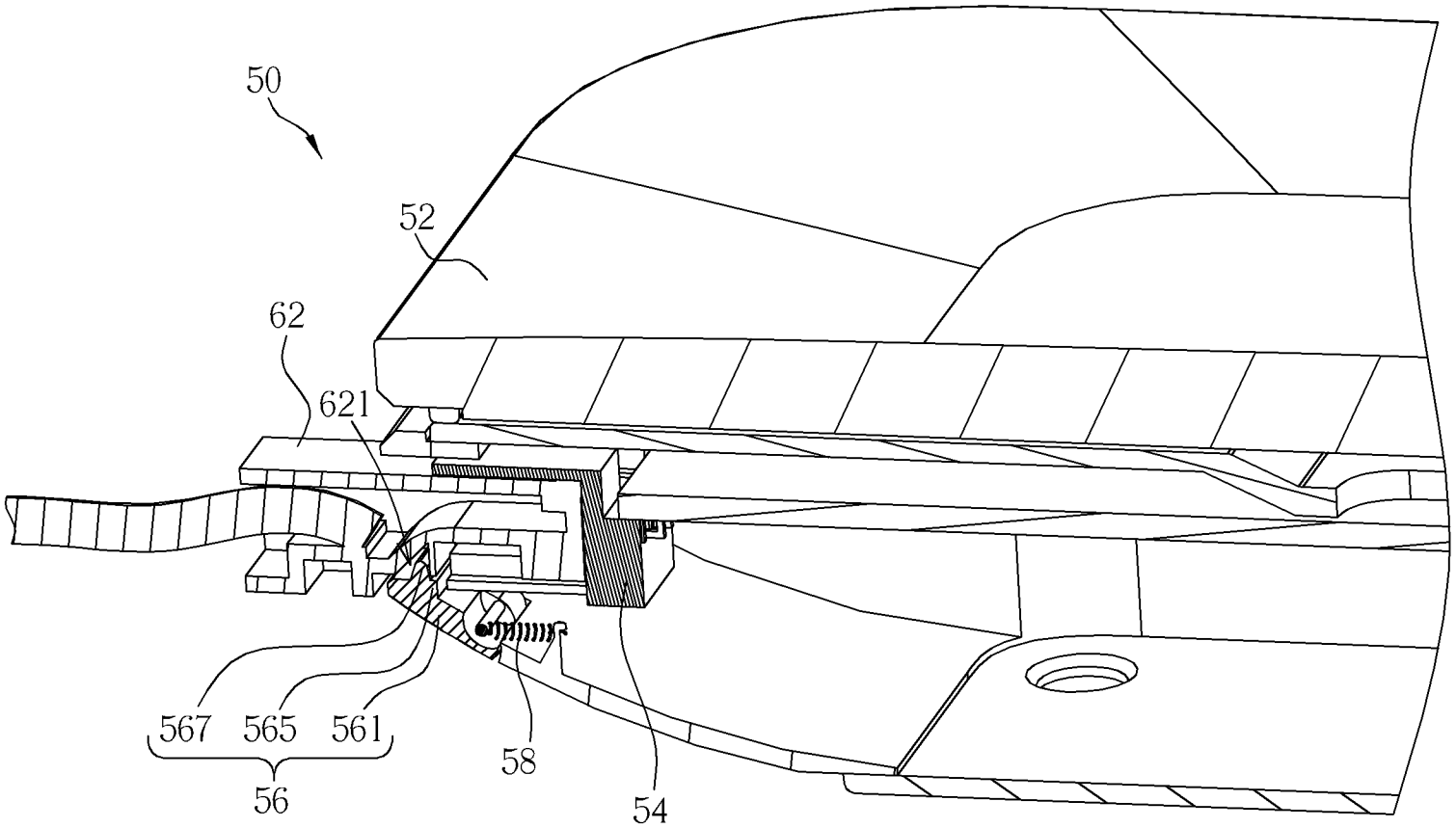

Please refer to FIG. 6 to FIG. 11. FIG. 6 to FIG. 8 are assembly diagrams of the connector mechanism 50 connecting with a plug 62 according to the embodiment of the present invention. FIG. 9 to FIG. 11 are sectional diagrams showing the connector mechanism 50 connecting with the plug 62 corresponding to FIG. 6 to FIG. 8 according to the embodiment of the present invention. As shown in FIG. 6 and FIG. 9, when the plug 62 has not been inserted into the opening 521 on the housing 52, the resilient component 58 can drive the main body 561 of the rotary covering 56 to shield the opening 521 for protecting internal components inside the housing 52 and providing a dustproof function. As shown in FIG. 7 and FIG. 10, when inserting the plug 62 into the opening 521 on the housing 52, the main body 561 of the rotary covering 56 can be pressed to rotate the rotary covering 56 relative to the housing 52 so as to allow the plug 62 to enter into the opening 521. An arc surface or an inclined surface can be formed on the engaging portion 567 for guiding the rotary covering 56 to counterclockwise rotate relative to housing 52 smoothly as being pushed by the plug 62. At this time, the resilient component 58, which is connected to the inner side of the housing 52 and the rotary covering 56, is extended.

As shown in FIG. 8 and FIG. 11, when the plug 62 has been inserted into the opening 521 on the housing 52 completely and an end of the plug 62 engages with the socket 54, there is no structural interference between the rotary covering 56 and the plug 62 and the resilient component 58 can provide a resilient restoring force to the rotary covering 56 so as to drive the rotary covering 56 to clockwise rotate relative to the housing. Then the engaging portion 567 of the rotating covering 56 can engage with an engaging structure 621 of the plug 62 so as to fix the plug 62 inside the connector mechanism 50. In this embodiment, the engagement of the engaging portion 561 and the engaging structure 621 can be achieved by a rib structure and a slot structure. The structural design for fastening the rotary covering 56 and the plug 62 is within the scope of the present invention.

On the other hand, when disassembling the plug 62 from the connector mechanism 50, the plug 62 can be pulled outwardly and the plug 62 can push the engaging portion 567 with the arc surface or the inclined surface so as to guide the rotary covering 56 to rotate relative to the housing 52, for releasing the engagement of the engaging portion 567 and the engaging structure 621. Then the plug 62 can be drawn out smoothly. After the plug 62 separates from the opening 521, the resilient component 58 can drive the main body 561 of the rotary covering 56 to shield the opening 521 again for protecting internal components inside the housing 52 and providing the dustproof function.

In contrast to the prior art, the connection mechanism 50 of the present invention utilizes the engagement of the engaging portion 567 of the rotating covering 56 and the engaging structure 621 of the plug 62 to fasten the plug 62, instead of the conventional plug with the deformable latching tang to be secured into the jack of the network port. It can solve the problems that the deformable latching tang tends might be physically fragile, and if broken by frequent insertion, it will not provide a fastening function of the plug with respective to the jack. Hence, there is no need to arrange the latching tang for the plug 62 cooperating with the connection mechanism 50 of the present invention, and the connection mechanism 50 of the present invention can cooperate with the conventional plug even with a broken latching tang, so as to enhance utilization convenience and product reliability.

Those skilled in the art will readily observe that numerous modifications and alterations of the device and method may be made while retaining the teachings of the invention.

What is claimed is:

1. A connector mechanism comprising:

a housing whereon an opening is formed;

a socket installed inside the housing and disposed on a side of the opening; and a rotary covering for rotatably covering the opening, the rotary covering comprising:

a main body;

a pivoting portion connected to the main body and pivoted to an inner side of the housing;

a stopping portion connected to the main body; and an engaging portion connected to the main body, for engaging with an engaging structure of a plug as the plug is inserted into the opening and fastened on the socket so as to fix the plug;

a resilient component connected to the inner side of the housing and the rotary covering, for driving the rotary covering to rotate relative to the housing so that the engaging portion engages with the engaging structure of the plug as the plug is fastened on the socket; and a stopping component disposed on the housing nearby the opening, for stopping the stopping portion of the rotary covering as the resilient component drives the rotary covering to rotate relative to the housing.

2. The connector mechanism of claim 1, wherein a size of the main body is substantially smaller than or equal to a size of the opening.

3. The connector mechanism of claim 2, wherein the resilient component is further for driving the rotary covering to cover the opening partially or completely as the plug is not inserted into the opening.

4. The connector mechanism of claim 1, wherein the pivoting portion is a shaft installed inside a slot of the housing in a rotatable manner.

5. The connector mechanism of claim 1, wherein an arc surface or an inclined surface is formed on the engaging portion for guiding the rotary covering to rotate relative to housing as being pushed by the plug.

6. The connector mechanism of claim 1, wherein the engaging portion and the engaging structure of the plug are respectively a rib structure and a slot structure.

7. The connector mechanism of claim 1, wherein the main body, the pivoting portion, the stopping portion and the engaging portion are monolithically integrated.

* * * * *